US009580194B2

(12) United States Patent
Cere'

(10) Patent No.: US 9,580,194 B2
(45) Date of Patent: Feb. 28, 2017

(54) WRAPPING MACHINE

(75) Inventor: Mauro Cere', Loiano (IT)

(73) Assignee: Aetna Group S.p.A. (IT)

( * ) Notice: Subject to any disclaimer, the term of this patent is extended or adjusted under 35 U.S.C. 154(b) by 623 days.

(21) Appl. No.: 14/110,777

(22) PCT Filed: Apr. 10, 2012

(86) PCT No.: PCT/IB2012/051745

§ 371 (c)(1),
(2), (4) Date: Oct. 9, 2013

(87) PCT Pub. No.: WO2012/140568

PCT Pub. Date: Oct. 18, 2012

(65) Prior Publication Data

US 2014/0033657 A1 Feb. 6, 2014

(30) Foreign Application Priority Data

Apr. 11, 2011 (IT) ..... MO2011A0074
Apr. 11, 2011 (IT) ..... MO2011A0075
Apr. 11, 2011 (IT) ..... MO2011A0076

(51) Int. Cl.
*B65B 11/00* (2006.01)
*B65B 11/58* (2006.01)
*B65B 35/24* (2006.01)

(52) U.S. Cl.
CPC ..... *B65B 11/00* (2013.01); *B65B 11/585* (2013.01); *B65B 35/24* (2013.01); *B65B 2011/002* (2013.01); *B65B 2210/20* (2013.01)

(58) Field of Classification Search
CPC ..... B65B 11/00; B65B 11/008; B65B 11/08; B65B 11/38; B65B 11/58; B65B 11/585;
(Continued)

(56) References Cited

U.S. PATENT DOCUMENTS 4,905,448 A * 3/1990 Plitt ..... B65B 11/025 53/176
5,140,795 A * 8/1992 Steding ..... B65B 11/025 53/168

(Continued)

FOREIGN PATENT DOCUMENTS

DE 10049922 A1 * 4/2002 ..... B65B 11/025
EP 0336517 A1 10/1989

(Continued)

*Primary Examiner* — Stephen F Gerrity
(74) *Attorney, Agent, or Firm* — Laubscher, Spendlove & Laubscher, P.C.

(57) ABSTRACT

A machine for wrapping a load with a film made of synthetic plastics includes a first frame suitable for supporting second frame that rotatably supports around, and slidably parallel to, a wrapping axis at least one wrapping unit including a reel of the film and a roller assembly arranged for unwinding and prestretching the film. The second frame is slidably mounted on the first frame and is movable along an advancing direction that is transverse, and in particular orthogonal, to the wrapping axis. A conveyor is provided for moving the load along the advancing direction. The conveyor and the second frame are movable in a mutually coordinated manner to wrap the load with the film also while the load is moved along the advancing direction.

11 Claims, 9 Drawing Sheets

(58) Field of Classification Search
CPC B65B 35/24; B65B 2011/002; B65B 2210/20
USPC ..... 53/556, 588, 210
See application file for complete search history.

(56) References Cited

U.S. PATENT DOCUMENTS

| | | | | | |
|---|---|---|---|---|---|
| 5,390,476 | A * | 2/1995 | Morantz | B65B 11/025 | 53/556 |
| 5,787,691 | A | 8/1998 | Turfan et al. | | |
| 5,996,315 | A * | 12/1999 | Scherer et al. | B65B 11/04 | 53/210 |
| 6,170,228 | B1 * | 1/2001 | Zeman, III | B65B 11/025 | 53/168 |
| 6,729,106 | B2 * | 5/2004 | Wiley | B65B 11/008 | 53/399 |
| 2004/0099110 | A1 * | 5/2004 | Cere | B65B 69/0033 | 83/78 |
| 2011/0030317 | A1 * | 2/2011 | Murarotto | B65B 35/24 | 53/399 |
| 2013/0081360 | A1 * | 4/2013 | Smith et al. | B65B 11/025 | 53/410 |

FOREIGN PATENT DOCUMENTS

| | | | | |
|---|---|---|---|---|
| EP | 0392933 | A1 | 10/1990 | |
| WO | WO 2008117161 | A2 * | 10/2008 | B65B 11/045 |

* cited by examiner

WRAPPING MACHINE

This application is a §371 National Stage Entry of PCT International Application No. PCT/IB2012/051745 filed Apr. 10, 2012. PCT/IB2012/051745 claims priority to IT Application No. MO2011A000074 filed Apr. 11, 2011 and IT Application No. MO2011A000075 filed Apr. 11, 2011 and IT Application No. MO2011A000076 filed Apr. 11, 2011. The entire contents of these applications are incorporated herein by reference.

BACKGROUND OF THE INVENTION

The invention relates to machines and methods for wrapping a load with a film made of extendible plastic material. In particular, the invention refers to a wrapping machine arranged for wrapping a film around a load to be packaged and to a corresponding wrapping method.

BRIEF DISCUSSION OF THE PRIOR ART

Known wrapping machines typically comprise a wrapping unit that supports a reel of film to be wrapped around the load (consisting of a product or a plurality of products grouped on a pallet), such as to form a series of pleated strips or bands, owing to the combination of the movement in a vertical direction of the wrapping unit and of the mutual rotation between the latter and the load around a vertical wrapping axis.

In wrapping machines provided with a rotating carousel supporting the load, the latter is rotated around the vertical wrapping axis, whereas the wrapping unit is moved vertically with reciprocating motion along a column or upright.

In wrapping machines with a rotating ring or a rotating arm, the load remains fixed during wrapping or binding, while the wrapping unit is moved in relation to the load rotating around, and translating along, the vertical wrapping axis. For this purpose, the wrapping unit is fixed to a ring, or to an arm, rotatably supported by a fixed structure of the machine and in such a manner as to rotate around the load.

The wrapping unit typically includes a carriage that supports not only the reel of film but also a pair of prestretching rollers arranged for unwinding from the reel the film and for optionally prestretching or elongating the film and one or more transmission rollers for diverting the film to the load. By adjusting the difference between the rotation speed of the prestretching rollers, it is possible to prestretch by a defined quantity or percentage the film and to vary the speed at which the of the film is unwound from the reel.

For high production speeds, rotating-ring or rotating-arm wrapping machines are generally used that enable film wrapping speeds to be obtained that are much higher than those that are obtainable in rotating carousel machines. In the latter, in fact, the rotation speed of the carousel has to be limited because of the centrifugal forces that are generated on the load and can compromise the stability thereof (typically in the case of a plurality of products grouped on a pallet).

In high-performance rotating-ring wrapping machines it is possible to complete a wrapping cycle in a very short time, for example 20-30 seconds.

One limit of known wrapping machines, also of the most efficient and fastest machines, resides in the fact that the load has to be introduced into the machine before wrapping and then extracted from the machine once it is completed. Such operating steps of introduction and extraction of the load require time and reduce considerably machine productivity.

In fact, a subsequent load cannot be wrapped until a work area of the wrapping machine (for example a zone underneath the rotating ring or the rotating carousel) has not been freed of the previous load. This drawback is clear, for example when the final load to be wrapped consists of a plurality of partial loads or groups of products to be wrapped first separately and then jointly. In this case, the time required for moving the single partial loads and the final load inside and outside significantly affects overall binding time, reducing machine productivity. In order to overcome this drawback, rotating ring or rotating arm wrapping machines are known that are movable along a rectilinear path, typically on tracks, in such a manner as to be able to operate in sequence on loads arranged on conveying apparatuses, typically roller conveyors, arranged together parallel and perpendicularly to the rectilinear path of the machine. In this manner, wrapping systems are created in which the wrapping machine, once it has finished wrapping a load, can be moved at an adjacent conveying apparatus and start wrapping another load while the wrapped load is conveyed to the exit.

Nevertheless, between one wrapping and the next at least the time elapses that is necessary for moving the wrapping machine from one conveying apparatus to the other. Further, due to the number and the arrangement of the conveying apparatuses, the wrapping system is very bulky and costly. One drawback of known wrapping machines, in particular of rotating ring or rotating arm machines, lies in the fact that they enable loads to be wrapped that have dimensions and volumes contained within a set range that depends on the dimensions of the machine. The maximum dimensions of the load cannot in fact exceed the dimensions of the work area of the wrapping machine, which is substantially defined by the helical trajectory traveled by the wrapping unit. The minimum load dimensions are those that enable the film to be wrapped around the load at the required tension.

In the case of loads or products having very variable dimensions it is thus necessary to dispose of a plurality of wrapping machines having different and suitable dimensions, this entailing huge financial investments. This problem occurs, for example, in the case of loads arranged on pallets of standard dimensions, which can vary from the 800×1200 mm of the European pallet to the 400×600 mm of the so-called "quarter" of European pallet.

The problem of the variability of the dimensions of the loads arises also with the gripping devices provided in wrapping machines to grasp the film at the end of wrapping and to retain one of the end flaps thereof obtained by cutting the film. As known, in fact, at the end of wrapping the portion of film comprised between the wrapping unit and the product has to be cut. Of the two end flaps generated by the cut, one is made to adhere and is generally glued or welded to a wall of the bound load, the other is grasped and retained by the gripping device to enable the subsequent load to be wrapped.

Typically, the gripping device is positioned below, adjacent to a conveyor or supporting carousel of the load. In some machines provided with a press for compressing on the upper part an unstable load and maintaining the load in position during wrapping, the gripping device is associated with the supporting structure of the latter.

In both constructional types, the gripping device is positioned in relation to the wrapping axis at a distance that is such as to enable the load of greater dimensions to be wrapped.

In the case of loads having smaller dimensions (for example European quarter pallets) the distance between the gripping device and the load can be excessive and can trigger wrapping that is not optimal and suitable and/or difficulties in fixing the free end flap of the film to the load.

Known wrapping machines have lengthy downtime for replacing the reel of film once it has finished. The reel can be replaced manually by one or more operators or automatically by movable carriages positioned adjacent to the machine.

In automated, more rapid and easier procedures, only the finished reel of film or the entire wrapping unit or carriage, comprising the prestretching rollers and the transmission rollers can be replaced. In such replacement or change procedures, the wrapping machine downtime is necessary both for replacing the reel (or the wrapping unit) and for positioning the movable carriage (which receives the finished reel of film and provides a new reel of film) with respect to the suitably stopped wrapping machine. Such reel-changing procedures, although they can also be automated, require a not insignificant time, which reduces the productivity of the wrapping machine.

SUMMARY OF THE INVENTION

One object of the invention is to improve known machines and methods for wrapping a load with a film made of extendible plastic material.

Another object is to make a wrapping machine and wrapping method that enable productivity to be considerably increased compared with known machines and wrapping methods.

A further object is to obtain a wrapping machine and a wrapping method that enable loads to be wrapped rapidly and efficiently that consist of a plurality of partial loads to be bound first separately and then jointly.

Still another object is to make a wrapping machine that enables loads to be wrapped in a very effective and optimum manner that have very different dimensions, such as, for example products arranged on a European pallet or products arranged on quarters of a pallet.

Still another further object is to make a wrapping machine having a relatively compact structure and efficient operation.

BRIEF DESCRIPTION OF THE FIGURES

The invention can be better understood and implemented with reference to the attached drawings that illustrate some embodiments thereof by way of non-limiting example, wherein.

DETAILED DESCRIPTION

Figure 1:
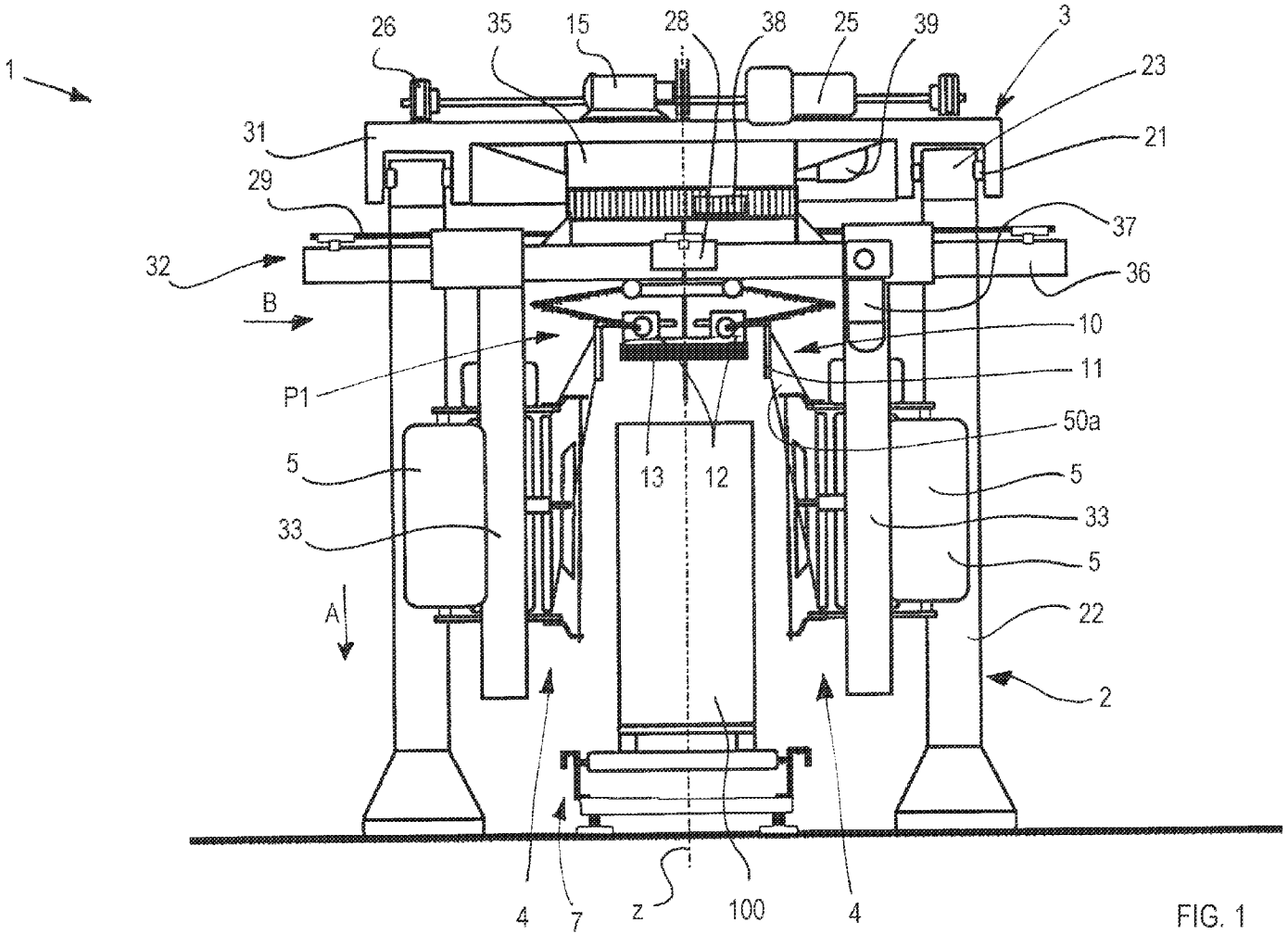
FIG. 1 is a frontal schematic view of a wrapping machine according to the invention in an initial wrapping start configuration.

With reference to FIGS. 1 to 4, a machine is illustrated for wrapping a load 100 with a film 50 made of plastic material comprising a first frame 2 and a second frame 3. The latter are supported by the first frame 2 and in turn support rotatably around and slidably parallel along a wrapping axis Z one or more wrapping units 4, each of which comprise a reel 5 of film 50 and a roller assembly 6 arranged for unwinding and possibly prestretching the film 50. The roller assembly 6 includes in particular a pair of prestretching rollers 61, 62 for example driven by respective motors 63, 64, to unwind the film from the reel 5 and prestretch the film by a defined percentage, and one or more transmission rollers 66.

The second frame 3 is slidably mounted on the first frame 2 such as to be movable along a first or advancing direction X that is transverse to the wrapping axis Z, in particular orthogonal to the latter. The first frame 2 defines a work area W inside which the wrapping units 4 are movable to wrap a load 100 that is fixed or movable along the aforesaid advancing direction X.

For this purpose, the wrapping machine 1 is provided with a conveying device 7 that is able to move the load 100 along the advancing direction X into and out of the machine 1 and through the work area W. As explained in greater detail below in the description, the conveying device 7 and the second frame means 3 are movable in a coordinated manner for wrapping the load 100 with the film 50 while the load 100 advances inside the work area W along the advancing direction X.

The first frame 2 includes guiding assembly 21, 23 supported by uprights 22 and slidably supporting carriage 31 of the second frame 3. In the embodiment illustrated in the figures, the guiding assembly includes pairs of guide or rectilinear rails 21 fixed to respective longitudinal first crosspieces 23 connected to upper ends of four uprights 22 of the first frame 2. A pair of second transverse crosspieces 24 connects the longitudinal first crosspieces 23 at the ends and ensures stability and strength to the first frame 2.

The carriage 31 is driven along the rectilinear guides 21 by a first motor 25. The latter, fixed to the carriage, drives a transmission including, for example, toothed wheels 26 acting on respective racks 27 fixed to the longitudinal first crosspieces 23.

The second frame 3 includes supporting device 32 rotatably supported by the carriage 31 and supporting one or more arms 33, for example two, to each of which respective wrapping units 4 are slidably connected.

The supporting device 32 includes a fifth wheel 35 that is rotatably connected to the carriage 31 and a rectilinear and substantially horizontal guiding element 36 fixed to the circular fifth wheel 35 and configured for slidably supporting the two arms 33.

The fifth wheel 35 is, for example, of toothed type and is engaged and rotated around the wrapping axis Z by a toothed pinion 38 driven by a second motor 39.

The arms 33 are substantially vertical, parallel to the wrapping axis Z and are movable along the guiding element 36 according to an adjusting direction B that is radial to the wrapping axis Z, such as to enable a distance of the wrapping units 4 from the load 100 to be adjusted. The arms 33 are moved along the guiding element 36 in opposite directions (i.e. towards or away from one another) by a third motor 28 by a transmission 29. The latter includes, for example, a driving screw 29 rotatably connected to the guiding element 36 and rotated by the third motor 28. The driving screw 29 engages and moves linearly respective nut screws of the arms 33 that are of known type and are not illustrated in the figures.

Each wrapping unit 4 is slidably mounted on the respective arm 33 in such a manner as to be movable along a wrapping direction A that is substantially vertical and parallel to the wrapping axis Z. Each wrapping unit 4 is driven by a respective fourth motor 37 by a transmission that is of known type and is not illustrated in the figures. In operation, the combination of the movement in a vertical direction of the wrapping units 4 and of the rotation of the latter with respect to the wrapping axis Z (by virtue of the rotation of the arms 33, i.e. of the guiding element 36) enables the load 100 to be wrapped with a series of pleated strips or bands of film 50.

It should be noted that the position of the arms 33 along the guiding element 36 can be set as a function of the dimensions of the load 100 to be wrapped, in such a manner that the distance between the wrapping unit 4 and the load 100 is optimal and such as to ensure that the film 50 is wrapped with the desired tension. Owing to this expedient, in particular in the case of loads of reduced dimensions, it is also possible to reduce considerably the centrifugal forces acting on the second frame 3 (in particular on the arms 33 and on the guiding element 36), as the distance (radius) can be reduced that separates the aforesaid arms 33 and the corresponding wrapping units 4 from the wrapping axis Z. Lesser centrifugal forces enable rotation speed of the arms 33 to be increased and simultaneously wrapping time and productivity of the wrapping machine 1 to be reduced. In another embodiment of the wrapping machine 1 of the invention that is not shown in the figures, the second frame 3 includes supports fixed to the carriage 31 and slidably supporting further supports, in particular along the wrapping direction A substantially parallel to the wrapping axis Z. The further supports in turn support a ring rotatably around the wrapping axis Z to which one or more wrapping units 4 is fixed. The wrapping machine 1 further comprises a gripping device 10 arranged for grasping and retaining an end flap 50*a* of film 50 obtained by cutting an end portion of film 50 when the load 100 has been completely wrapped.

For this purpose, each wrapping unit 4 includes a cutting device 16 that is able to cut the end portion of film interposed between the roller assembly 6 and the load 100 to obtain the end flap 50*a* retained by the gripping device 10 and a further end flap to be fixed to the load 100. A fixing device 17 is provided and associated with each wrapping unit 4 for fixing, in particular by gluing or welding, the further end flap 50*a* to an outer surface of the load 100 that is already wrapped by the film 50.

The gripping device 10 is slidably connected to the second frame means 3 and is movable along a first operating direction C1, that is in particular substantially radial to the wrapping axis Z, in such a manner as to regulate the distance of the gripping device 10 from the load 100 as a function of the dimensions of the load. The gripping device 10 is further movable along a second operating direction C2, which is substantially parallel to the wrapping axis Z, between a disengaged position P1 in which it is spaced away from the load 100, for example to enable the load 100 to be wrapped with the film 50, and an engaged position P2, wherein the gripping device 10 is adjacent to the load 100 for grasping and retaining the film 50 wrapped on the latter. With particular reference to the FIG. 1, the gripping device 10 includes one or more grippers 11, the same in number as the number of wrapping units 4 with which they have to interact. Each gripper 11 is slidably connected to and supported by a gripper body 12 such as to be movable along the first operating direction C1. Each gripper 11 is moved in relation to the gripper body 12 by a respective actuator, for example a pneumatic actuator of known type that is not illustrated in the figure.

The gripper body 12 is in turn slidably connected to the second frame 3 and in particular to the carriage 21, such as to be movable along the second operating direction C2.

In the illustrated embodiment, the gripper bodies 12 of the gripping device 10 are associated with a press 13 that is movable vertically along a direction that is parallel to the wrapping axis z (and to the second operating direction C2) between a raised non-operating position and a lowered operating position in which they abut on, press and stabilize the load 100 during the wrapping cycle.

The press substantially comprises a pressing plate 13 connected to the second frame 3 and in particular to the carriage 21 by a displacement device 14, comprising, for example, an articulated mechanism, such as a parallelogram with articulated arms (pantograph), and driven between the raised non-operating position and the lowered operating position to the load by a fifth motor 15.

The gripping device 10 (in particular the gripper bodies 12) is fixed to the pressing plate 13 in such a manner as to be movable with the latter along the second operating direction C2.

It should be noted that the disengaged position P1 of the gripping device 10 coincides with the raised non-operating position of the pressing 13 and the engaged position P2 of the gripping 10 coincides with the lowered operating position of the pressing plate 13.

It should also be noted that the position of the grippers 11 along the first operating direction C1 can be set as a function of the dimensions of the load 100 to be wrapped, such that the distance of the aforesaid grippers 11 from the load 100 is optimal. Owing to this technical solution it is possible to effectively fix the free end flap of the film 50 to the load and to start a subsequent wrapping cycle correctly. The wrapping machine 1 can further includes a cloth unwinding unit 40 fixed to the first frame 2 and arranged for depositing a covering cloth on the top of the load 100 while the latter is introduced into the machine by the conveyor device 7 along the advancing direction X. The covering cloth has dimensions that are such as to cover the top of the load 100 and go over the sides in such a manner as to be maintained in position by the wrapping film 50. The covering cloth is maintained in position on the load 100 owing to the pressing plate 13 moved to the lowered operating position. The conveyor device 7 includes, arranged in sequence along the advancing direction X, a first conveyor 41, a second conveyor 42, a third conveyor 43 and optionally a fourth conveyor 44, each of which include, for example, a respective driven roller conveyor of known type.

The conveyors 41, 42, 43, 44 are drivable independently and enable a plurality of loads 100 to be moved into and out of the wrapping machine and through the work area W.

Figure 3:
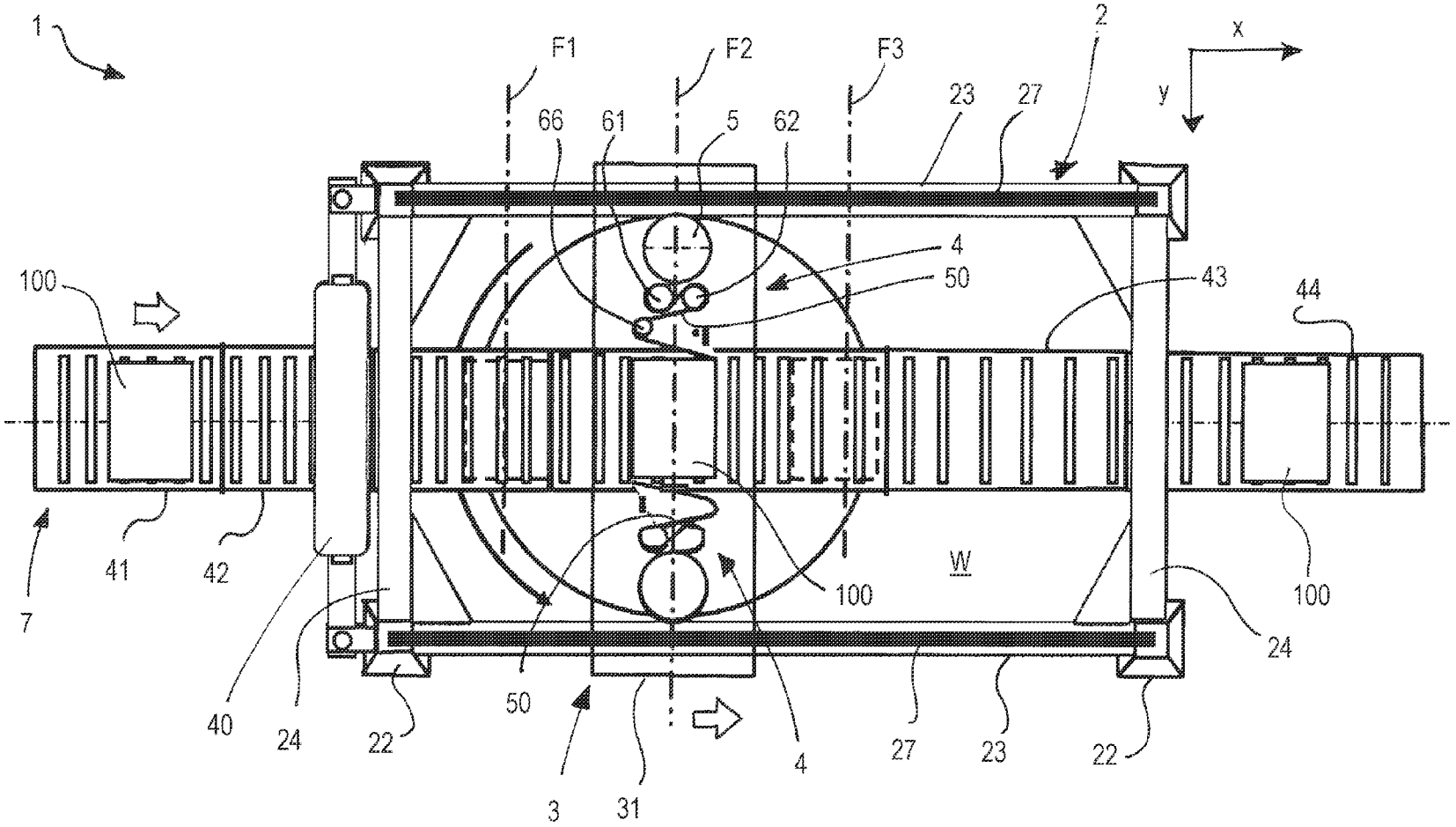
FIG. 3 is a schematic top plan view of the machine in FIG. 2.

With reference to FIG. 3, a wrapping or binding cycle of a load 100 is run by the wrapping machine 1 according to a wrapping procedure or method that comprises the operating steps disclosed below.

In an initial step the load 100, arranged on the first conveyor 41, is transferred onto the second conveyor 42, which moves the load inside the machine 1 to a first operating position F1 in the work area W.

If the wrapping machine 1 comprises the cloth unwinding unit 40, the load 100 receives a covering cloth while it is introduced inside the machine 1.

When the load 100 reaches the first operating position F1, the second frame 3, i.e. the carriage 31, is driven from this first operating position F1 and in particular moved at the same transferring speed as the second conveyor 42 along the advancing direction X to enable the load 100 to be wrapped during motion.

The pressing plate 13 can be lowered to abut on the top of the load 100 and block the covering cloth as well as maintaining the load stable. The grippers 11 of the gripping device 10, that retain the terminal flaps 50*a* of the films 50, moved from the disengaged position P1 to the engaged position P2 as they are fixed to the pressing plate 13, are also moved along the first operating direction C1 and positioned according to the dimensions of the load 100.

At the same time the arms 33 (and the corresponding wrapping units 4) are moved towards the load 100 by the third motor 28 along the guiding element 36 of the supporting device 32. The position of the arms 33 along the adjusting direction B is a function of the dimensions of the load 100.

The descent operations of the pressing plate 13 and the operations for adjusting the positions of the gripping device 10 and of the wrapping units 4 with respect to the load 100 are performed during the transferring of the latter to the second conveyor 42 from the first operating position F1 to a second operating position F2 during which the actual step of wrapping with the film 50, starts, by rotating the supporting device 32 around the wrapping axis Z and subsequently by moving the wrapping units 4 along the wrapping direction A. During rotation, the wrapping units 4, via the respective roller assembly 6 unwind and prestretch the film 50 from the reels 5, the film 50 is then wrapped onto the load 100 in superimposed and pleated bands.

The film 50 is wrapped while the load 100 is moved by the second conveyor 42 from the second operating position F2 to a third operating position F3. At the same time, the second conveyor 42 is able to move in the advancing direction X inside the work area W a subsequent load 100 that is received from the first conveyor 41.

At the third operating position F3, while the load 100 continues to be moved at a constant speed, the supporting device 32 is arrested as well as the prestretching rollers 61, 62 to enable the gripping device 10 to grasp and retain the end flap 50*a* of the film 50 obtained by cutting the end portion of film interposed between the roller means 6 and the load 100 through the cutting device 16. The further end flap obtained by cutting the film 50 is fixed to the load 100 by the fixing means 17.

Once both the films 50 of the wrapping units 4 are grasped, the gripping device 10, together with the pressing plate 13 to which it is fixed, is returned to the disengaged position P1. While the completely wrapped load 100 is transferred from the second conveyor 42 to a third conveyor 43 leaving the work area W, the subsequent load 100 is moved as far as the first operating position F1.

In the meantime, the second frame 3, i.e. the carriage 31, is returned to the first operating position F1 to start wrapping of the subsequent load 100.

It should be observed that the wrapping procedure of the invention enables the time to be reduced that is necessary for conducting a wrapping cycle, as it is carried out by maintaining the load 100 in continuous movement along the advancing direction X with a transferring speed that is, for example, substantially constant. Further, the load 100 to be wrapped enters the machine while wrapping of the previous load is ending and/or while the latter is moved outside the wrapping machine.

Owing to the wrapping machine and to the wrapping method according to the invention it is thus possible to increase productivity considerably with respect to known wrapping machines and methods.

Figure 4:
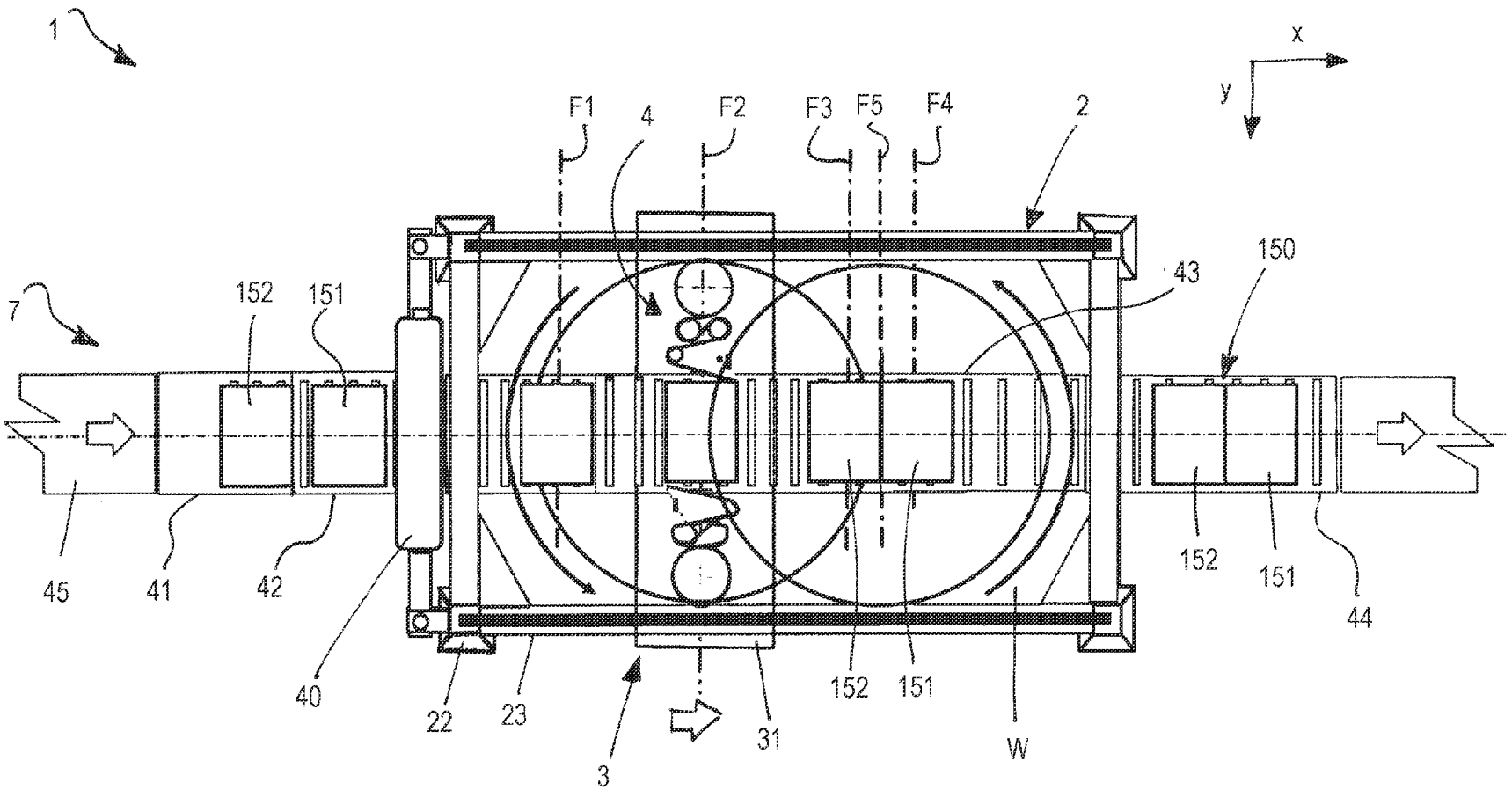
FIG. 4 is a schematic plan view of the machine in FIG. 1 in association with a plurality of loads to be wrapped and in different operating positions.

With reference to FIG. 4, there is shown a wrapping or binding cycle of a complete or final load 150 that consists of a plurality of partial loads 151, 152, for example two, that are arranged adjacently to one another longitudinally along the advancing direction X and to be wrapped first separately and then jointly (2×1 arrangement). The wrapping cycle is run by the aforesaid wrapping machine 1 of the invention according to a wrapping procedure or method that includes the steps illustrated below.

In an initial step the two partial loads 151, 152 (for example two pallets of products) are loaded coupled on the first conveyor 41, for example by an entry conveyor 45 or by another movement apparatus.

The first conveyor 41 is then driven in such a manner as to transfer the first partial load 151 onto the second conveyor 42 which is in turn driven to move the first partial load 151 into the machine 1 in the work area W. In this manner the two pallets 151 and 152 are spaced apart and separated along the advancing direction X to be bound separately with the film 50.

If the wrapping machine 1 includes the cloth unwinding unit 40, the first partial load 151 moved singly onto the second conveyor 42 receives a respective covering cloth while it is introduced into the machine 1.

When the first partial load 151 reaches the first operating position F1, the second frame 3, i.e. the carriage 31, is driven from this first operating position F1 and in particular moved at the same transferring speed as the second conveyor 42 along the advancing direction X to enable the first partial load 151 to be followed and wrapped.

The pressing plate 13 can be lowered to abut on the top of the first partial load 151 and block the covering cloth as well as maintaining the products stable that are present there. The grippers 11 of the gripping device 10 that retains the end flaps 50*a* of the films 50 are moved along the first operating direction C1 and positioned as a function of the dimensions of the first partial load 151.

At the same time the arms 33, and the corresponding wrapping units 4, are moved towards the first partial load 151 by the third motor 28 along the guiding element 36 of the supporting device 32. The position of the arms 33 along the adjusting direction B is a function of the dimensions of the first partial load 151.

The descent operations of the pressing plate 13 and operations of adjusting the positions of the gripping device 10 and of the wrapping units 4 with respect to the first partial load 151 are performed during the transferring of the latter onto the second conveyor 42 from the first operating position F1 to a second operating position F2 in which the wrapping step of the first partial load 151 with the film 50 starts, by rotating the supporting device 32 and the arms 33 around the wrapping axis Z and subsequently the wrapping units 4 moving along the wrapping direction A.

During rotation, the wrapping units 4, via the respective roller assembly 6, unwind and prestretch the film 50 from the reels 5, which film is then wrapped in superimposed and pleated bands onto the first partial load 151.

Wrapping with the film 50 occurs while the first partial load 151 is moved by the second conveyor 42 from the second operating position F2 to a third operating position F3 in which the supporting device 32 is stopped as well as the prestretching rollers 61, 62 to enable the gripping device 10 to grasp and retain the end flap 50*a* of the film 50 obtained by cutting the end portion of film interposed between the roller assembly 6 and the load 100, by the cutting device 16. The further end flap obtained by cutting the film 50 is fixed to the first partial load 151 by the fixing device 17. Once the films 50 of the wrapping units 4 are grasped, the gripping device 10, together with the pressing means 13 to which it is fixed, is returned to the disengaged position P1. At this point the second frame 3, i.e. the carriage 31, can be returned to the first operating position F1 to start wrapping of the second partial load 152. At the same time the second conveyor 42 is driven to transfer the first partial load 151 to a third conveyor 43 in a fourth operating position F4 in which this first partial load 151 is maintained.

The second conveyor 42 moves at the same time the second partial load 152, coming from the first conveyor 41, inside the machine 1 in the work area W as far as the first operating position F1.

If the wrapping machine 1 includes the cloth unwinding units, the second partial load 152 receives a respective covering cloth during the motion.

When the second partial load 152 reaches the first operating position F1 the wrapping cycle is started up according to the steps disclosed above for the first partial load 151. At the end of the wrapping cycle the second partial load 152 is in the third operating position F3, which is substantially adjacent to and abutting on the first partial load 151. The second frame 3, i.e. the carriage 31, is thus moved along the advancing direction X to a fifth operating position F5 that is substantially equidistant between the two partial loads 151, 152. In this position, joint wrapping takes place of the first partial load 151 and of the second partial load 152 that are again gathered to form the complete load 150.

The complete load 150 is wrapped with the second frame 3 fixed in relation to the advancing direction X. Nevertheless, this wrapping can occur during motion along the advancing direction X, the third conveyor 43 being of suitable length in this case.

If the partial loads are more than two (arrangement 3×1, 4×1, . . . ) at the end of the wrapping cycle of the second partial load 152, the latter and the first partial load 151 are made to advance adjacent and abutting along the advancing direction X as far as a further operating position on the third conveyor 43. At the same time, the second frame 3 is returned to the first operating position F1 to start wrapping of a subsequent partial load according to the methods already disclosed for the second partial load 152. At the end of the wrapping cycle the subsequent partial load is in the third operating position F3 that is substantially adjacent to and abutting on the second partial load 151.

At this point, the second frame 3 can be moved to a median operating position that enables the three partial loads to be wrapped jointly or be returned to the first operating position F1 to start wrapping of a further subsequent partial load, whereas the three partial loads that are already wrapped are moved adjacent and abutting on one another along the advancing direction X, as far as a further operating position on the third conveyor 43.

At the end of wrapping of the final load 150, the second frame 3 can be returned to the first operating position F1 to start the wrapping cycle of a subsequent load, while the wrapped load 150 is transferred from the third conveyor 43 to a fourth conveyor 44 leaving the wrapping machine 1. It should be observed that the wrapping procedure disclosed above enables a load 150 consisting of two or more partial loads or pallets of products 151, 152 to be wrapped by a single wrapping machine first separately and then jointly. The procedure enables costs to be contained and the time to be reduced that is necessary for wrapping the load partially and completely. Also in this case, the wrapping is carried out by maintaining the partial loads 151, 152 in continuous motion along the advancing direction X at a substantially constant transferring speed.

Figure 5:
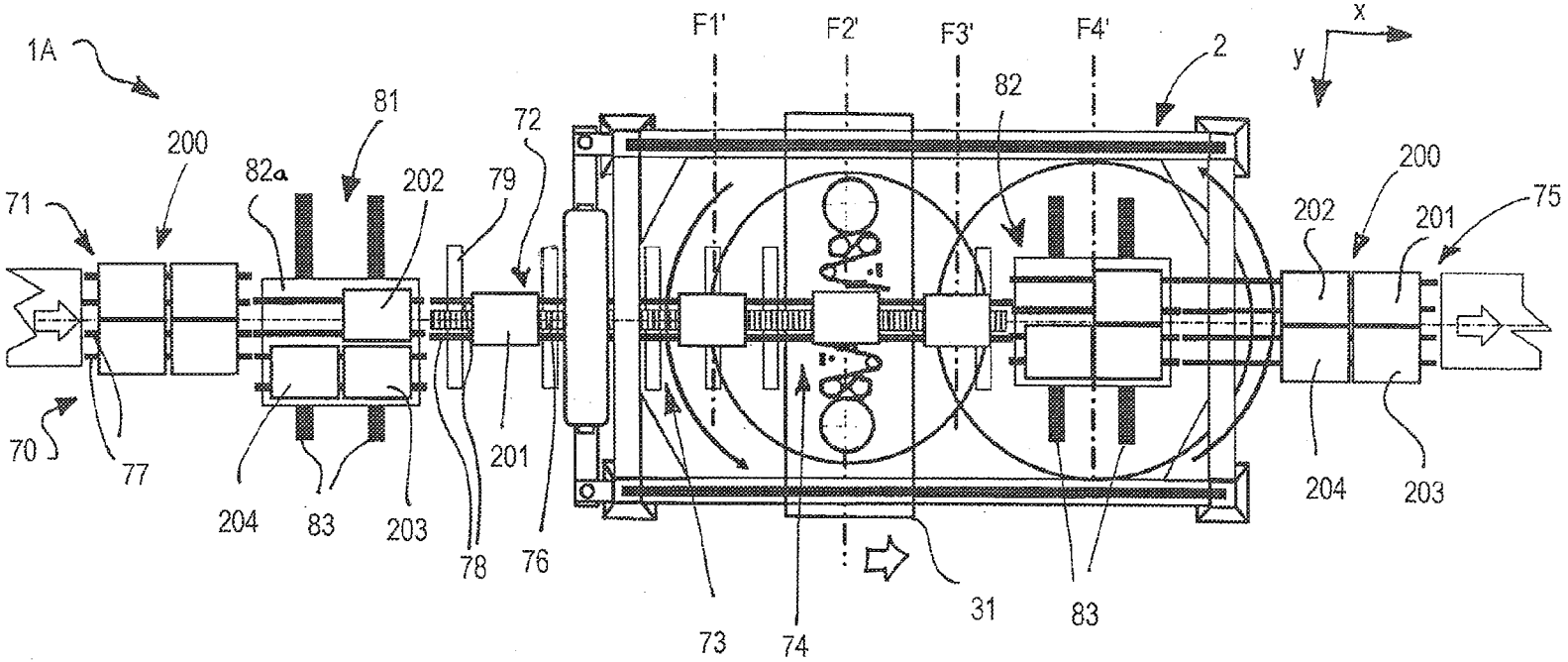
FIG. 5 is a schematic plan view of a version of the machine in FIG. 1.

FIG. 5 illustrates a version of the wrapping machine 1A of the invention that differs from the previously disclosed embodiment by the fact that it comprises a conveying device 70 that is able to move a load 200 consisting of a plurality of partial loads 201, 202, 203, 204, for example four, that are arranged adjacent to one another longitudinally along the advancing direction X and transversely along an approach direction Y, the partial loads 201, 202, 203, 204 being wrapped first separately and then jointly. The approach direction Y is transverse, in particular orthogonal, to the advancing direction X.

The conveying device 70 includes a first conveyor 71 that is able to receive four partial loads 201, 202, 203, 204 (for example pallets of products) that are next to and longitudinally and transversely adjacent one another (2×2 arrangement) to form the complete or final load 200. The partial loads are, for example, so-called "quarter" pallets or European pallets (400×600 mm) to be wrapped separately before being gathered and wrapped jointly to form a complete load 200 on a European pallet (800×1200 mm).

The first conveyor 71 comprises two or more first transport devices 77 arranged parallel to one another and to the advancing direction X such as to support and move independently the partial loads positioned thereupon along the aforesaid advancing direction. Each first transport device 77 includes, for example, two driven belts, the mutual distance of which along the transverse approach direction Y can be adjusted as a function of the dimensions of the partial loads 201, 202, 203, 204 (width of the belts). Similarly, the distance or wheelbase between the first transport device 77 can also be adjusted along the approach direction Y as a function of the dimensions of the partial loads 201, 202, 203, 204.

The conveying device 70 further comprises a second conveyor 72, a third conveyor 73 and a fourth conveyor 74 arranged in sequence along the advancing direction X for moving the single partial loads 201, 202, 203, 204 into and through the work area W of the wrapping machine 1A.

Figure 6:
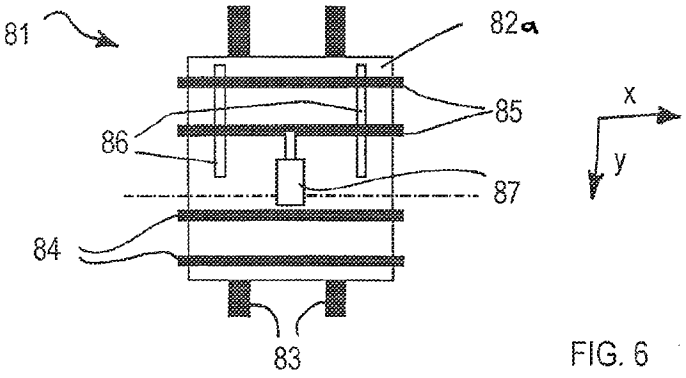
FIG. 6 is a plan view of shuttle means of the wrapping machine in FIG. 5.

Each of the aforesaid conveyors 72, 73, 74 includes a central conveyor 76, for example a driven belt, and a pair of side guides 78 placed longitudinally to the opposite sides of the central guide 76. The distance or wheelbase between the two side guides 78 can be adjusted along the approach direction Y and in relation to the central conveyor 76 as a function of the dimensions of the partial load 201, 202, 203, 204 to be moved. For this purpose, the two side guides 78 are slidably mounted on respective transverse guides 79. The conveying device 70 includes a fifth conveyor 75 for conveying the wrapped load 200 outside the wrapping machine. The fifth conveyor 75 is substantially identical to the first conveyor 71 from which it may differ by the different length. The conveying device 70 further includes a first shuttle 81 interposed between the first conveyor 71 and the second conveyor 72 and a second shuttle 82 interposed between the fourth conveyor 74 and the fifth conveyor 75. The first shuttle 81 and the second shuttle 82 are able to move the partial loads 201, 202, 203, 204 both along the advancing direction X and along the approach direction Y. In particular, the first shuttle 82 enables the partial loads 201, 202, 203, 204 to be transferred singly on the second conveyor 72 in such a manner as to be detached and separated from one another. The second shuttle 81 is able to receive and group the partial loads 201, 202, 203, 204 to be wrapped together in the load 200 and to transfer the latter outside the fifth conveyor 75. With particular reference to the FIG. 6, the first shuttle 81 includes a platform 82*a* that is movable along the approach direction Y on guide rails 83, fixed to a supporting plane of the wrapping machine. The platform 83 supports two or more further transport devices, for example a second transport device 84 and a third transport device 85 arranged parallel to the advancing direction X. The second transport device 84 is fixed to the platform 83, while the third transport device 85 is mounted slidably on said platform 82*a*, movable and adjustable in position on respective guides 86 along the approach direction Y. The third transport device 85 is moved by respective actuating means 87 including, for example, a pneumatic or electric linear actuator.

In this manner, as explained below, the distance or wheelbase between the further transport devices 84, 85 can also be modified by separating and spacing the partial loads and enabling the single transfer thereof to the second conveyor 72.

The second transport device 84 and the third transport device 85 each comprise, for example, two respective driven belts, the distance of which from one another, along the approach direction Y can be adjusted as a function of the dimensions of the partial loads 201, 202, 203, 204.

The second shuttle 82 is identical to the first shuttle means 81.

The wrapping or binding cycle of the load 200 consisting, for example, of the four partial loads or pallets of products 201, 202, 203, 204 to be wrapped first separately and then jointly is performed by the wrapping machine 1A according to a wrapping procedure or method that comprises the steps disclosed below.

In an initial step the four partial loads 201, 202, 203, 204 are transferred, next to and longitudinally and transversely adjacent to one another to form the load 200, from the first conveyor 71 to the first shuttle 81. For this purpose, the two first transport devices 77 of the first conveyor 71 are aligned respectively on the second transport device 84 and on the third transport device 85 of the first shuttle 81.

Once the partial loads 201, 202, 203, 204 have been transferred to the first shuttle 81 the third transport device 85 is spaced apart from the second transport device 84 along the approach direction Y for separating and spacing transversely a pair of partial loads 201, 202 from the remaining pair of partial loads 203, 204.

Substantially at the same time the platform 82*a* of the first shuttle 81 is moved along the approach direction Y to align the third transport device 85 on the second conveyor 72 and to enable a first partial load 201 to be transferred to the second conveyor 72.

Figure 2:
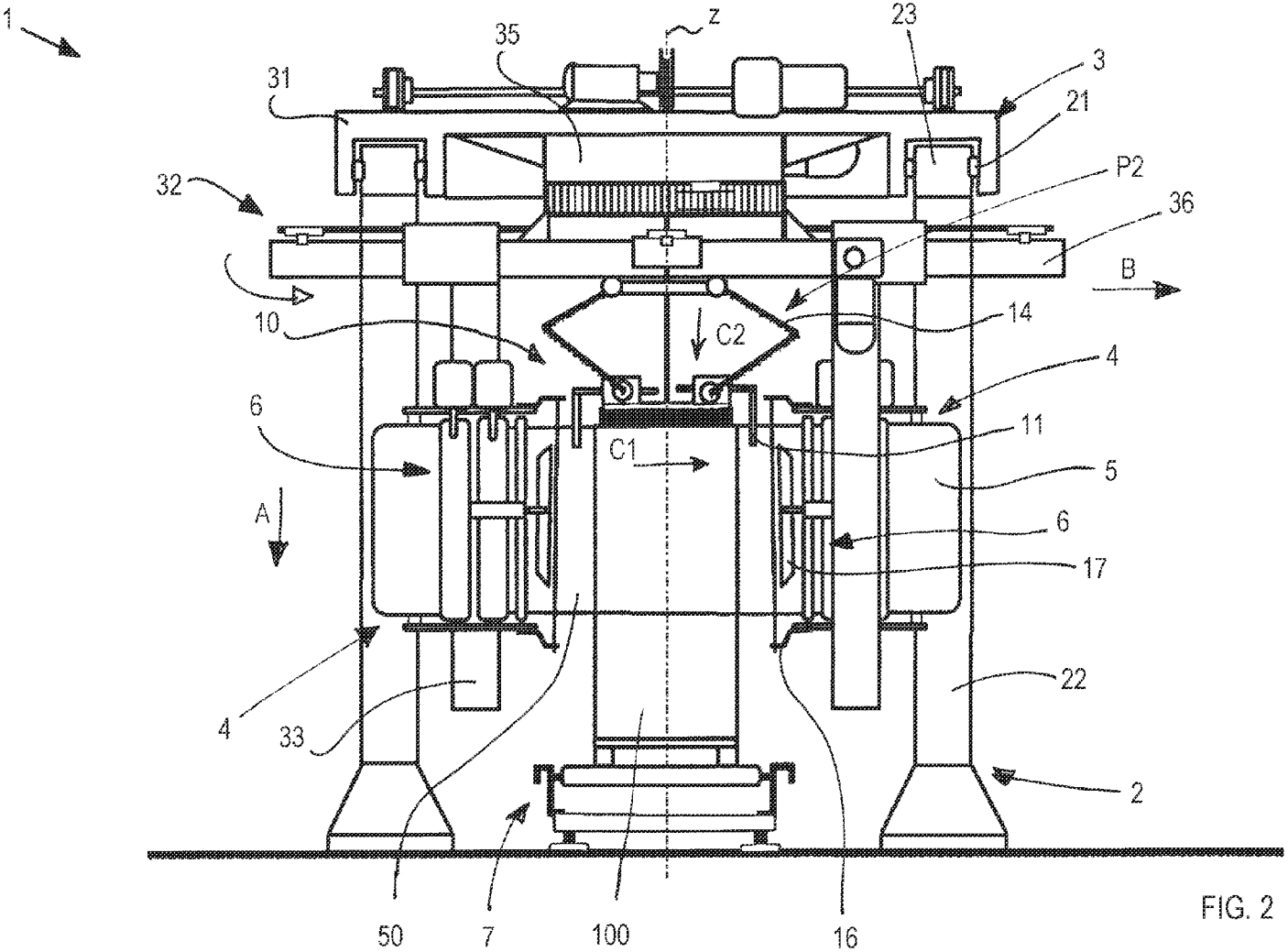
FIG. 2 is a view like the one in FIG. 1 that illustrates wrapping machine in an operating configuration of wrapping a film around a load.

The wrapping procedure of the aforesaid partial load is substantially identical to that illustrated in FIG. 2 and disclosed previously.

The second conveyor 72 moves the first partial load 201 inside the machine 1A in the work area W. If the wrapping machine 1A includes the cloth unwinding units, the first partial load 201 receives a respective covering cloth while it is being introduced into the machine 1A.

When the first partial load 201 reaches a first operating position F1', the second frame 3 is moved at the same transferring speed as the second conveyor 74 so that the pressing plate 13 can be lowered to abut on the top of the first partial load 201 and lock the covering cloth and the grippers 11 of the gripping device 10 that retains the end flaps 50*a* of the films 50 can be moved along the first operating direction C1 and positioned in function of the dimensions of the first partial load 201.

At the same time the arms 33 are moved towards the first partial load 201 as a function of the dimensions of the latter. When the first partial load 201 reaches a second operating position F2' the wrapping step starts, which rotates the supporting device 32 around the wrapping axis Z and subsequently the wrapping units 4 moving along the wrapping direction A. Wrapping with the film 50 occurs while the first partial load 201 is moved by the second conveyor 42 from the second operating position F2 to a third operating position F3' in which the supporting device 32 is stopped as well as the prestretching rollers 61, 62 to enable wrapping to be completed.

The second frame 3 is then returned to the first operating position F1' to start wrapping of the second partial load 202, which in the meantime has been transferred by the first shuttle 81 to the second conveyor 72 and moved by the latter in cooperation with the third conveyor 73 as far as the first operating position F1'. At the same time the third conveyor 74 is driven to transfer the first partial load 201 to the second shuttle 82. The platform 82*a* of the latter is positioned along the approach direction Y in such a manner that, for example, the third transport device 85 is aligned on the fourth conveyor 74.

Once the second partial load 202 has been transferred to the second conveyor 72, the platform 82*a* of the first shuttle 81 is positioned along the approach direction Y in such a manner that the second transport device 84 is aligned on the fourth conveyor 74 to enable the subsequent transferring of the third and the fourth partial load 203, 204.

Similarly, when the second shuttle 82 receives the second partial load 202, the corresponding platform 82*a* is positioned along the approach direction Y in such a manner that the second conveyor 84 is aligned on the fourth conveyor 74 to enable the third and the fourth partial load 203, 204 to be subsequently transferred.

Once the four singly wrapped partial loads 201, 202, 203, 204 have been received that are coupled and adjacent along the advancing direction X, the third transport device 85 of the second shuttle 82 is moved towards the second transport device 84 along the approach direction Y to gather the pairs of partial loads 201, 202, 203, 204, which can thus be wrapped jointly to form the load 200.

For this purpose, the second frame 3, once wrapping of the fourth partial load 204 has terminated, continues to move along the advancing direction X as far as a fourth operating position F4' in which it stops and in which wrapping of the load 200 starts with the same methods as those used for wrapping the single partial loads.

After wrapping of the load 200 has terminated, while the load 200 is transferred from the second shuttle 82 to the fifth conveyor 75 exiting the wrapping machine 1, the second frame 3 and thus the wrapping units 4 are returned to the first operating position F1' to start wrapping of the first partial load 201 of a subsequent load 200.

The procedure disclosed above applies, with minimal modifications and additions, also in the case of a load to be wrapped including more than four partial loads, for example having more than two partial loads along the advancing direction X and/or along the approach direction (arrangements 3×2, 2×3, 3×3, . . . ).

It should be observed that owing to the wrapping procedure disclosed above and to the wrapping machine 1A of the invention it is possible to wrap with only one wrapping machine a load 200 including of a plurality of partial loads or pallets of products 202, 202, 203, 204 to be wrapped first separately and then jointly. In particular, the partial loads 202, 202, 203, 204 that are initially next to and longitudinally and transversely adjacent to one another are separated to be wrapped singly with the film 50 and then gathered and wrapped jointly to form the load 200.

Owing to the procedure of the invention it is possible contain costs and reduce the time necessary for performing a partial and complete load wrapping cycle. Also in this case, wrapping is performed by maintaining the partial loads 201, 202, 203, 204 in continuous motion along the advancing direction X at a substantially constant transferring speed. With particular reference to FIGS. 7 to 10, a version of the wrapping machine 1B is illustrated including a reel-changing apparatus 90 for replacing the wrapping units 4 mounted on the arms 33 and including, for example, respective finished reels 5' of film 50, with wrapping units 4 including respective new reels 5 of film 50.

Each wrapping unit 4 includes a plate 65 that supports the reel 5 of film 50 and the roller assembly 6. The latter includes a pair of prestretching rollers 61, 62 driven by respective motors 63, 64 and one or more transmission rollers 66. The cutting device 16 and the fixing means 17 of the end flap of film 50 are also fixed to the plate 65.

The reel-changing apparatus 90 includes a supporting element 91 provided with a plurality of brackets 92, for example three, each of which is able to hook and support with a shaped end 92*a* a respective wrapping unit 4 with a finished reel 5' that has been received from the wrapping machine 1 or a respective wrapping unit 4 with a new reel 5 of film to be transferred to the wrapping machine 1. The brackets 92 are substantially coplanar and angularly equidistant. The number of brackets 92 is equal to the number of wrapping units 4 on the wrapping machine plus one (to receive the first wrapping unit 4 dismantled from the wrapping machine).

The supporting element 91 is mounted slidably by a column 93 on a linearly movable carriage 94, for example on rails 95 and driven by a first driving device 96. In this manner the reel-changing apparatus 90 is movable between a first operating position H1, wherein it is spaced apart from the wrapping machine 1B, and a second operating position H2, wherein it is adjacent to the wrapping machine 1B. A second driving device 97 enables the column 93 and the supporting element 91 to be rotated around a respective longitudinal and vertical axis, in such a manner as to selectively position the brackets 92 in a position in which the reel-changing apparatus 90 is able to receive or transfer a wrapping unit 4.

Each wrapping unit 4 is connected reversibly to the respective arm 33 by a hooking device 60. The latter is mounted slidably on the corresponding arm 33 and driven along the latter according to the wrapping direction A by the fourth motor 37.

The procedures for replacing the wrapping units 4 (illustrated partially in FIGS. 7 to 10) provides the steps disclosed below.

In an initial step, the reel-changing apparatus 90, provided with two new wrapping units 4 (i.e. provided with new reels 5 of film 50) fixed to respective brackets 92, is moved towards the wrapping machine 1B in the second operating position H2. For this purpose, the first driving device 96 is activated to move the carriage 94 along the rails 95. The second driving device 97 is activate for rotating the supporting element 91 in such a manner that the empty bracket 92 faces the wrapping machine 1B.

Figure 7:
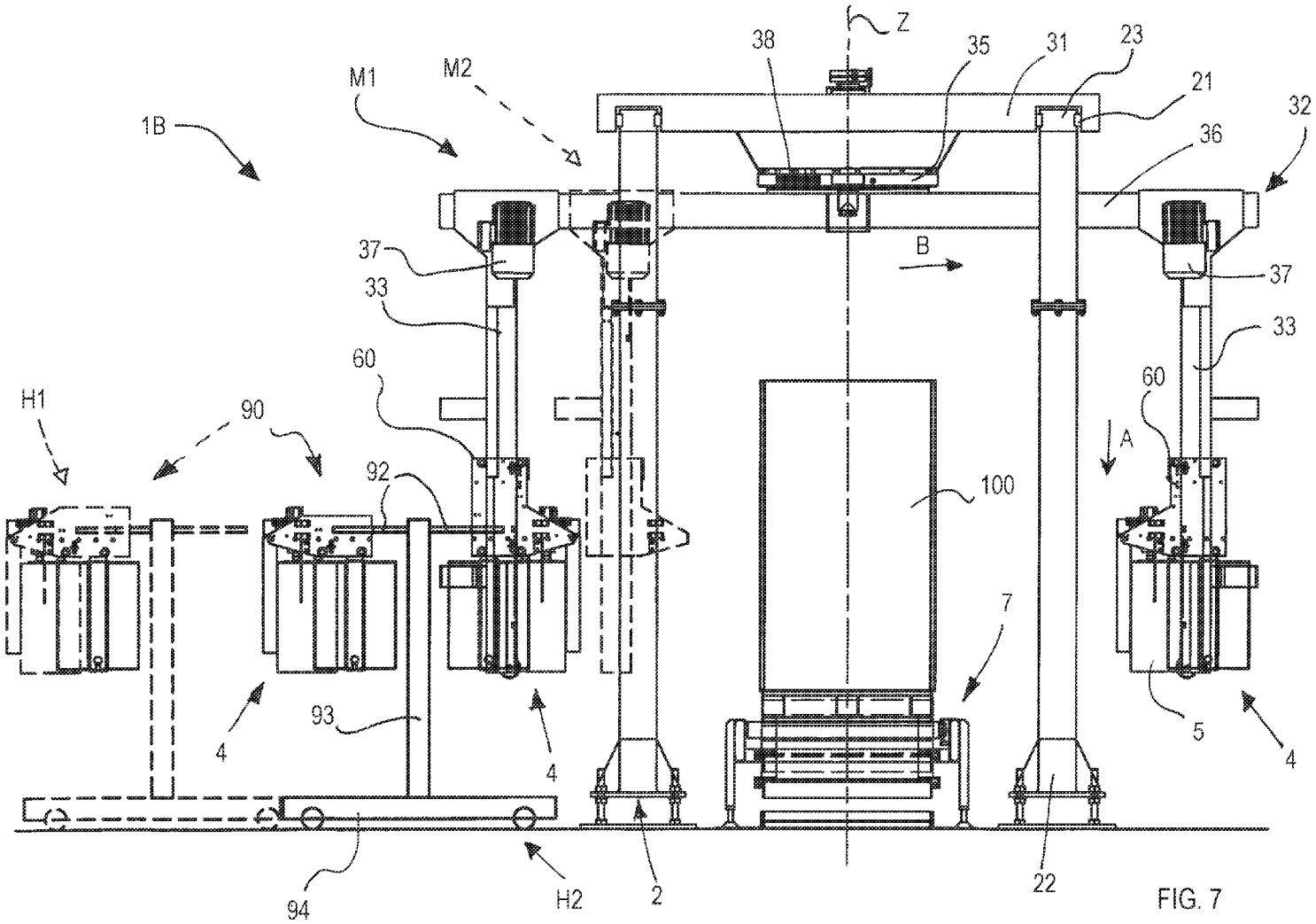
FIG. 7 is a schematic front view of another version of the wrapping machine of the invention comprising a reel-changing apparatus.
Figure 8:
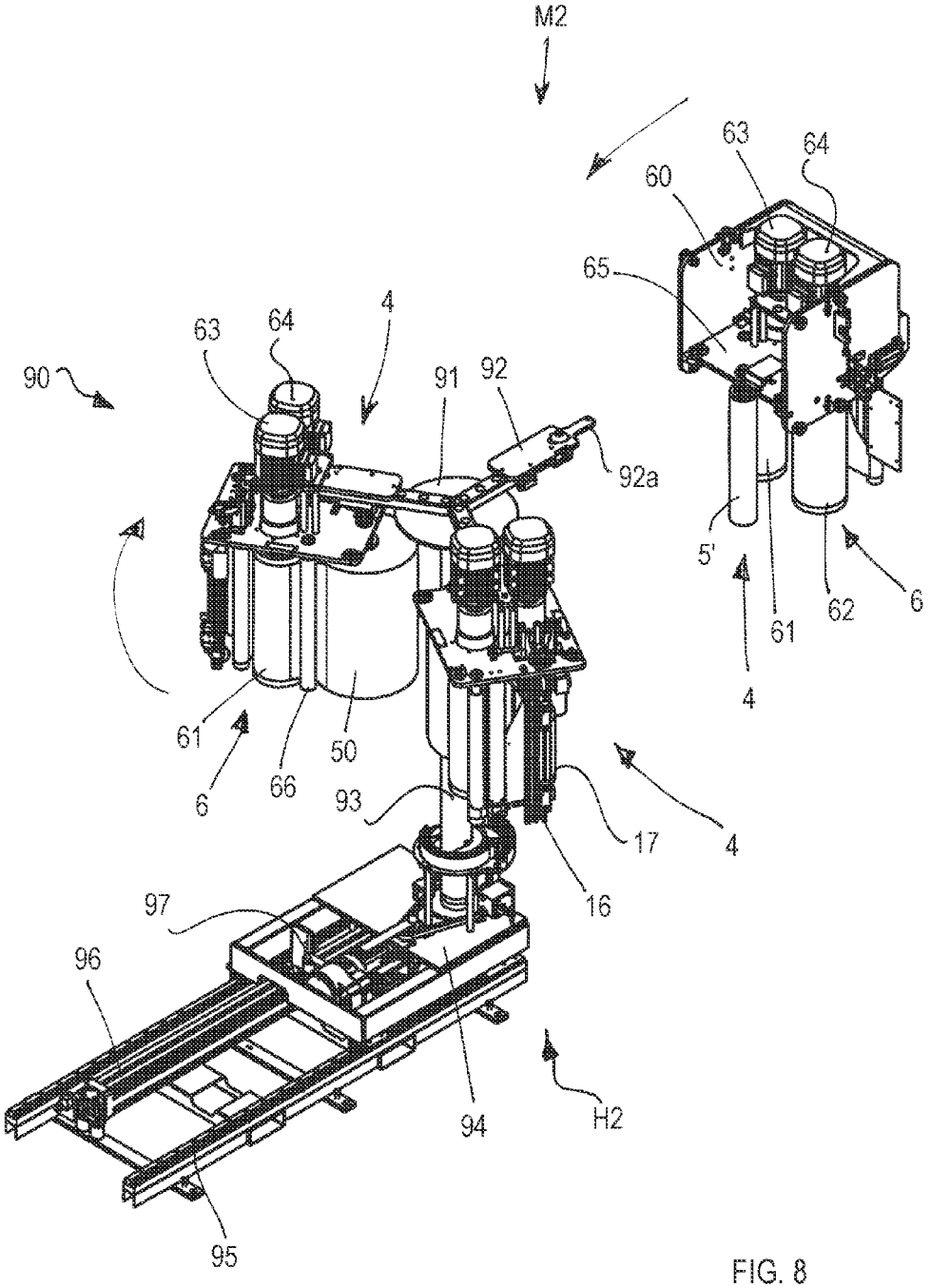
FIGS. 8, 9 and 10 are perspective views of the reel-changing apparatus of the machine in FIG. 7 in association with hooking devices of a wrapping unit of the wrapping machine and in successive operating steps of a change procedure, respectively.

The supporting device 32 of the wrapping machine 1B is rotated such that the wrapping unit 4 to be replaced faces and is aligned on the reel-changing apparatus 90. At the same time, the hooking means 60 of the aforesaid wrapping unit 4 is moved along the corresponding arm 33 in such a manner as to position the wrapping unit 4 along the wrapping direction A, i.e. vertically, at a height from the ground that is such as to enable interacting with the bracket 92 (FIG. 7).

Figure 9:
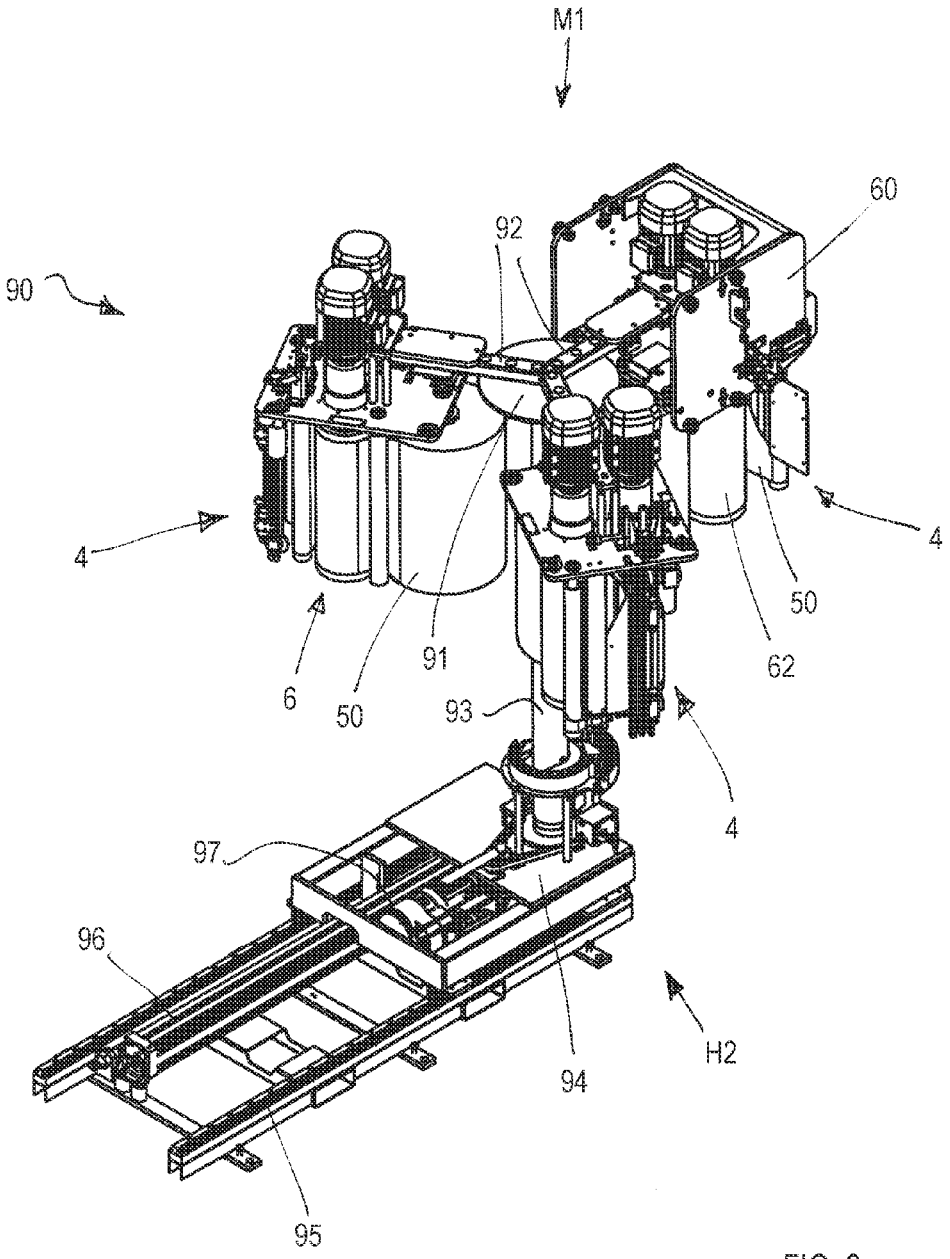
Figure 10:
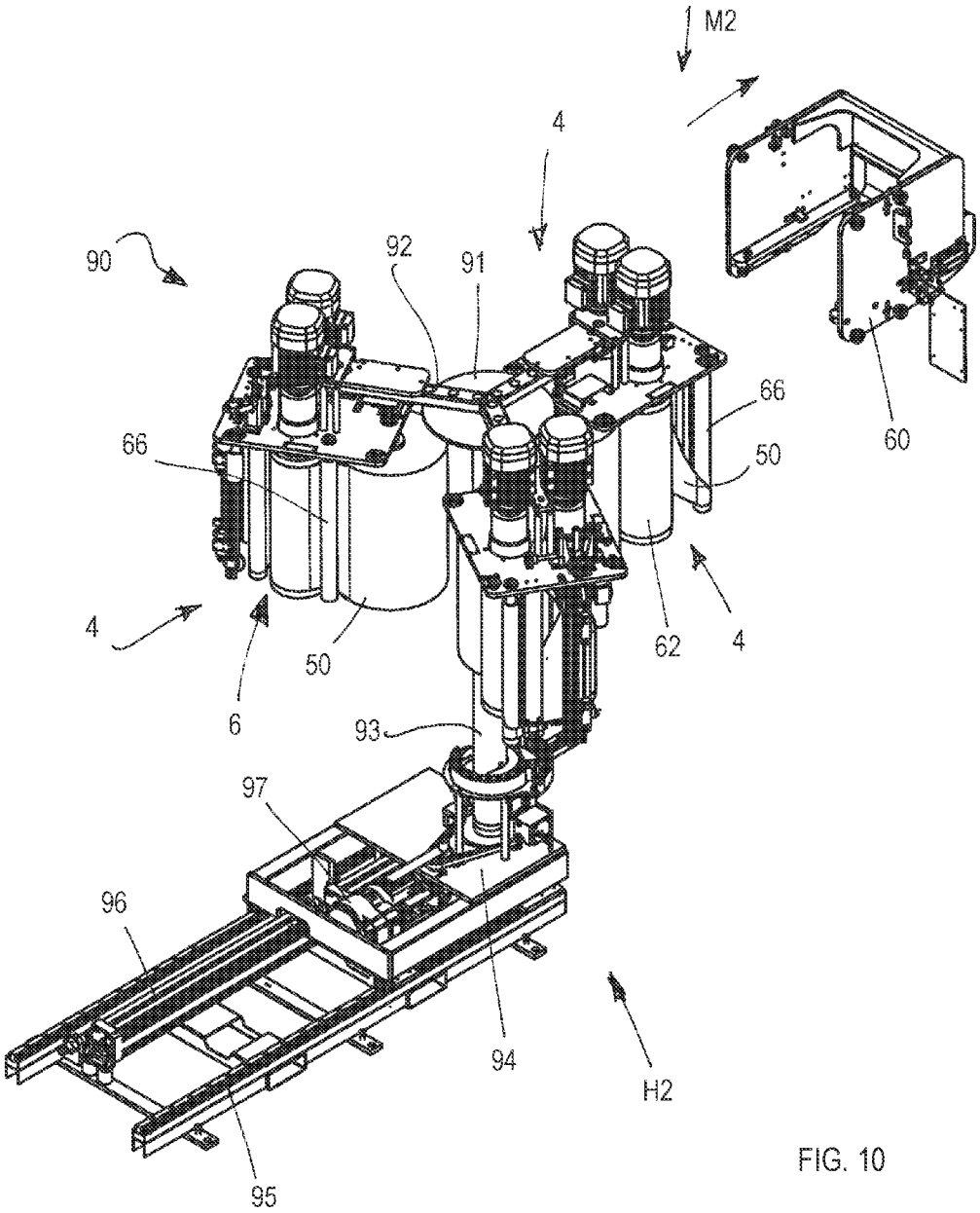

At this point, the arm 33 bearing the wrapping unit 4 to be replaced is moved along the guiding element 36 to an external change position M1 in which the aforesaid wrapping unit 4 can be hooked and supported by the free bracket 92 (FIG. 9). Once the wrapping unit 4 is unhooked from the hooking device 60 of the arm 33, the latter can be moved away from the change apparatus 90 to a retracted position M2 (FIG. 10). It is thus possible to rotate the supporting element 91 in such a manner that a bracket 92 supporting a new wrapping unit 4 faces the hooking device 60 of the arm 33. The latter is moved again along the guiding element 36 from the retracted position M2 to the change position M1, such as to enable the hooking device 60 to hook and remove the new wrapping unit 4. The arm 33 with the new wrapping unit 4 is thus moved to the retracted position M2.

The operating sequence disclosed above can be repeated in a substantially identical manner to perform the replacement of the wrapping unit 4 present on the second arm 33.

In one embodiment of the wrapping machine that is not illustrated, the reel-changing apparatus 90 is arranged in a position that does not interfere with the movement of the arms 33 and of the corresponding wrapping units 4 during the wrapping cycle.

Owing to the wrapping machine 1B of the invention it is thus possible to replace automatically, without the manual intervention of operators, the wrapping units 4 provided with finished reels 5' of film with corresponding wrapping units 4 provided with complete reels 5 of film, reducing in this manner machine downtime. The arms 33 that are movable along the guiding element 36 as far as the change position M2 enable the change procedures to be facilitated and accelerated, further reducing the time required to perform change procedures.

The invention claimed is:

1. A machine for wrapping a load with a film made of synthetic plastic material around a wrapping axis, comprising (a) a first frame;

(b) a second frame that is slidably mounted on said first frame and movable with respect to said first frame along a first direction that is orthogonal to said wrapping axis;

(c) at least one wrapping unit supported on said second frame, said wrapping unit including a reel of said film and being rotatable around and slidable parallel to said wrapping axis;

(d) roller means arranged adjacent to said wrapping unit for unwinding and prestretching said film; and (e) conveying means for moving said load along said first direction, said conveying means and said second frame means being movable in a mutually coordinated manner to wrap with said film about said load while the latter is moved along said first direction.

2. A machine as defined in claim 1, wherein said first frame comprises guiding means for supporting and slidably guiding a carriage of said second frame.

3. A machine as defined claim 2, wherein said second frame comprises supporting means rotatably supported by said carriage for supporting at least one arm to which said at least one wrapping unit is slidably connected.

4. A machine as defined in claim 3, wherein said wrapping unit is movable on said arm along a wrapping direction substantially parallel to said wrapping axis.

5. A machine as defined in claim 4, wherein said arm is slidably mounted on said supporting means and is movable along a radial adjusting direction relative to said wrapping axis in order to adjust a distance of said wrapping unit from said load.

6. A machine as defined in claim 2, wherein said second frame comprises supporting means fixed to said carriage for slidably supporting further supporting means that is movable along a wrapping direction substantially parallel to said wrapping axis, said further supporting means rotatably supporting a ring around said wrapping axis to which said at least one wrapping unit is fixed.

7. A machine as defined in claim 1, wherein said conveying means comprises a plurality of independently driven roller conveyors arranged in sequence along said first direction.

8. A machine as defined in claim 1, wherein said conveying means comprises first and second shuttle means arranged for moving loads along said first direction and along an approach direction that is orthogonal to said first direction, said first shuttle means being arranged for separating and transferring said loads to be wrapped inside the wrapping machine and said second shuttle means being arranged for receiving and grouping said loads to be wrapped jointly in a complete load and to transfer the latter outside the wrapping machine.

9. A machine as defined in claim 8, wherein said conveying means comprises first, second, third, fourth, and fifth conveyors arranged in sequence along said first direction, said first shuttle means being arranged between said first conveyor and second conveyors and said second shuttle means being arranged between said fourth and fifth conveyors.

10. A machine as defined in claim 9, wherein said first and fifth conveyors comprise respective pairs of first transport devices arranged parallel to one another and to the first direction to support and independently move independently said loads along said first direction.

11. A machine as defined in claim 8, wherein said each of said first and second shuttle means includes a platform that is movable along said approach direction on guide rails and supporting second and third transport devices arranged parallel to one another and to said first direction, said third transport device being slidably mounted on said platform and movable and adjustable in position with respect to said second conveyor along said approach direction.

* * * * *